US006716316B2

(12) United States Patent
Grabscheid et al.

(10) Patent No.: US 6,716,316 B2
(45) Date of Patent: Apr. 6, 2004

(54) PROCESS FOR CONDITIONING A CIRCULATING FELT BELT

(75) Inventors: Joachim Grabscheid, Gerstetten (DE); Ulrich Begemann, Heidenheim (DE); Oswald Satzger, Giengen (DE); Wolfgang Mayer, Heidenheim (DE); Ralf Rziha, Gerstetten (DE); Wolfgang Bamberger, Heidenheim (DE); Georg Kleiser, Heidenheim (DE); Thomas Rühl, Wernau (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/032,090

(22) Filed: Dec. 31, 2001

(65) Prior Publication Data

US 2002/0129914 A1 Sep. 19, 2002

(30) Foreign Application Priority Data

Jan. 18, 2001 (DE) ..... 101 02 199

(51) Int. Cl.[7] ..... D21F 1/32

(52) U.S. Cl. ..... 162/199; 162/198; 162/162; 162/275

(58) Field of Search ..... 162/198, 199, 162/263, 272, 274–279, 252, 262, DIG. 6, DIG. 10; 700/127, 128, 129; 73/38, 49.5, 49.6, 76

(56) References Cited

U.S. PATENT DOCUMENTS

| | | | | | |
|---|---|---|---|---|---|
| 3,859,163 | A | * | 1/1975 | Haythornthwaite | 162/198 |
| 3,948,721 | A | | 4/1976 | Winheim | 162/207 |
| 4,378,639 | A | | 4/1983 | Walker | 34/12 |
| 5,135,615 | A | * | 8/1992 | Rokman | 162/263 |
| 5,349,845 | A | * | 9/1994 | Blom | 73/38 |
| 5,595,632 | A | * | 1/1997 | Macierewicz | 162/277 |
| 5,725,737 | A | * | 3/1998 | Pikulik et al. | 162/263 |
| 5,900,117 | A | * | 5/1999 | Lidar | 162/199 |
| 5,964,956 | A | | 10/1999 | Straub et al. | |
| 6,143,092 | A | | 11/2000 | Straub et al. | |

FOREIGN PATENT DOCUMENTS

| | | |
|---|---|---|
| DE | 4305493 | 8/1994 |
| DE | 4419540 | 1/1995 |
| DE | 19860567 | 6/2000 |
| EP | 0024205 | 2/1981 |
| EP | 0383486 | 8/1990 |
| FR | 2604199 | 3/1988 |
| WO | 98/45533 | 10/1998 |

OTHER PUBLICATIONS

English Language Abstract of JP 03234885.
English Language Abstract of DE 44 19 540.
English Language Abstract of EP 0 383 486.
English Language Abstract of DE 198 60 567.
English Language Abstract of EP 0 024 205.
European Search Report (in German) dated Jul. 11, 2003 conducted in European Patent Application No. 01 12 5586.

* cited by examiner

*Primary Examiner*—Eric J. Hug
*Assistant Examiner*—Eric Hug
(74) *Attorney, Agent, or Firm*—Greenblum & Bernstein, P.L.C.

(57) ABSTRACT

Process for conditioning a circulating felt belt of a machine, pipe suction apparatus and traversing pipe suction apparatus therefor, the process including performing a zonal conditioning of a plurality of zones across a width of the felt belt by measuring at least one of, fibrous material web cross direction profile; felt belt cross direction profile; and permeability of the felt belt across the width of at least one of the web and the belt. The felt belt is conditioned depending on measuring results obtained for a respective zone. The pipe suction apparatus includes a ceramic body extending at least essentially across the entire width of the felt belt, the ceramic body being provided with a slotted surface by way of which the felt belt is subjectable to vacuum, with a respective effective amount of slotted surface being zonally variably adjustable by way of movable tongues.

76 Claims, 2 Drawing Sheets

PROCESS FOR CONDITIONING A CIRCULATING FELT BELT

CROSS-REFERENCE TO RELATED APPLICATIONS

The present application claims priority under 35 U.S.C. §119 of German Patent Application No. 101 02 199.2, filed Jan. 18, 2001, the disclosure of which is expressly incorporated by reference herein in its entirety.

BACKGROUND OF THE INVENTION

1. Field of the Invention

The invention relates to a process for conditioning a circulating felt belt of a machine, in particular a paper machine, used to produce a fibrous material web, in particular a paper or cardboard web.

A corresponding treatment or conditioning of felt belts can serve, for example, to improve the profile quality of felt and paper, to improve the web running properties, and possibly also an increase in the stability of the dewatering and/or the dry matter content, etc.

2. Discussion of Background Information

At least one pressing felt is generally used for pressing the paper web for the purpose of increasing the dry matter content. In order to achieve an even as possible increase of the dry matter content crosswise to the machine direction, i.e., an even moisture cross direction profile, various felt conditioning devices are used. As a rule, these devices comprise a device for drawing water into the felt and a subsequent device that suctions out of the felt the water that has been drawn into it.

In spite of such a felt conditioning, an uneven loading of the felt with contaminants and an uneven compression of the felt occur during the service life of the felt, which leads to an uneven dewatering in the pressing nip. Up to now, a correction of the resulting uneven moisture cross direction profile has been performed by means of a zonal temperature increase in the press nip by applying water steam to the paper web. However, this does not eliminate the causes of the unevenness in the condition of the felt.

In a paper machine known from U.S. Pat. No. 4,378,639, the fibrous material web is constantly monitored for dry streaks in the drying section and the web is correspondingly moistened depending on the results of the monitoring. In a conditioning process known from DE-A-44 19 540, various methods are used for conditioning felt belts. Paper machines are also already known in which the respective state of a felt is monitored in order to be able to perform the conditioning of the felt depending on the detected condition of the felt (cf., for example, EP-A-0 383 486, EP-A-0 024 205). In a paper machine known from DE-A-198 60 567, the conditioning of each transport belt occurs depending on the contamination of this transport belt that is detected.

SUMMARY OF THE INVENTION

Other exemplary embodiments and advantages of the present invention may be ascertained by reviewing the present disclosure and the accompanying drawing.

One aspect of the invention resides in further developing the process of the type mentioned at the outset in such a way that the moisture cross direction profile can be optimally corrected in order to attain an even moisture cross direction profile, in particular.

In order to attain this goal, a process is recommended according to the invention for conditioning a circulating felt belt of a machine, in particular a paper machine, used to produce a fibrous material web, in particular a paper or cardboard web, in which a conditioning is performed in zones across the felt belt width, in that at least one fibrous material web property cross profile and/or at least one felt belt property cross profile such as, in particular, the water content of the felt belt across the width of the web and/or the belt and/or the permeability of the felt belt across the width of the web and/or the belt is measured and the felt belt is conditioned in each of the various zones depending on the measuring results obtained for the applicable zones.

The zonal conditioning can, for example, occur in addition to a conditioning that is effective across the entire belt width. However, this is not obligatory in any case.

Thus, for example, it is possible in particular to correct deviations in the moisture cross direction profile and to achieve an even moisture cross direction profile by means of a targeted treatment or conditioning of the felt in places where deviations of the felt properties from the desired values occur and, e.g., a particularly high degree of compression or contamination, a deviation from the desired water content and/or the like is present. Here, it is possible, for example, to apply water at compressed places in the felt and/or to suction water off at compressed points in the felt or to blow water out using pressurized air, using a spraying pipe, for example, a high-pressure spraying pipe.

According to a suitable practical design of the process according to the invention, a mean value is calculated from measured values obtained for the various zones and the intensity of the conditioning in a respective zone is selected depending on the deviation of the measured result from the mean value.

It is possible, for example, for the following devices to be used individually or in any desired combination with one another for the purpose of zonal felt conditioning.

Thus, the felt conditioning can occur at least partially, for example, by means of at least one traversing spraying pipe nozzle. Using an appropriate guide, it is thus possible to approach all points across the width of the felt. The nozzle can, e.g., either travel across the felt belt at an even speed, in which case the water pressure can be correspondingly regulated with the cross profile deviation as a correcting variable, or the speed of the nozzle and thus its lag time at various positions can be regulated, at a constant water pressure, with the cross profile deviation as a correcting variable.

Alternatively or additionally, the felt conditioning can at least partially occur also by means of at least one spraying pipe comprising several nozzles, which can be controlled zonally and can also preferably be moved over the width of the zone. For a targeted conditioning of individual felt areas, the individual spraying pipe nozzles can each be controlled by the relevant valves.

Alternatively or additionally, the felt conditioning can at least partially occur also by means of a zonally controllable pipe suction apparatus that is additionally preferably movable over the width of the zone. Using such a pipe suction apparatus, individual regions of the felt can be suctioned in a targeted manner.

A pipe suction apparatus can be used, for example, that has a ceramic body extending at least essentially over the entire width of the felt, which ceramic body is provided with a slotted surface by way of which the felt belt can be subjected to vacuum, with the effective slotted portion of the surface being variably adjustable by zones, in particular using movable tongues, e.g., metal tongues in order to correspondingly vary, in particular, the respective effective time of the vacuum.

However, the felt conditioning can, for example, also occur at least partially by means of at least one traversing short pipe suction apparatus that has a ceramic body that is provided with a slotted surface by way of which the felt belt can be subjected to vacuum, where the effective slotted portion of the surface may be variably adjusted by means of at least one movable tongue, e.g., a metal tongue, in order to correspondingly vary, in particular, the respective effective time of the vacuum.

Further examples of possibilities for treating and/or conditioning the felt are as follows:

- Pressurized air for blowing out water, e.g., regulation of the water content
- Chemical conditioning additives, profiling by means of amount and/or dosing, e.g., regulation of the permeability
- All types of treatment and/or conditioning are possible on the paper side and/or the running side.

The significance of even moisture cross direction profiles after a pressing section is a deciding factor for the degree of effectiveness and the quality of the final product. If, for example, moist areas occur, the strength of the web is reduced at that point, which is connected with a significantly greater tendency to tear. For example, altered tension requirements in the drying section and the adjustment of the tension in the drying section after the most moist area should be mentioned; it should be taken into account here that too great of a tension at dry areas can, in particular, lead to the formation of creases. Moreover, a complete evening out of the moisture cross direction profile in the drying section is not possible in many cases. If the paper machine includes a calender, moist areas have a considerable influence on the quality properties of gloss and smoothness that can be achieved with the calender.

In many cases, uneven felt properties such as, in particular, an uneven permeability and an uneven water content, are the causes of irregularities in the moisture cross direction profile.

Conventional presses have exclusively conditioning devices acting evenly across their width such as, in particular, low-pressure and high-pressure spraying pipes and DuoCleaner.

Web running problems in connection with the felt conditioning are, for example:

- Edge pulling during felt separation. In other words, in felt separation after double felt presses, the edge of the paper web is removed in places from the felt guiding the paper by the removed felt.
- Edge lifting and/or edge folding. The edges of the paper do not have sufficient adhesion on the felt and/or the necessary difference between the upper felt and the lower felt is not sufficient.

These irregularities can be caused by the surface properties of the felts. The properties in question are determined by the fleece properties/refinements and by the conditioning.

The properties in question are dependent less on the type of conditioning and/or treatment than on the requirements of the different or adapted application of the treatment.

Therefore, there are various options for felt treatment, including treatment in sections for improving the profile qualities of the felt and the paper web.

A further aspect of the invention is therefore, in particular, the guarantee of good web running properties. Certain properties across the width of the felt, especially in the edge regions, must be taken into account. Moreover, differences between the upper felt and the lower felt should be eliminated. In other words, the profile correction can only move within a working window that is determined by the web running requirements. Web running properties are, in particular, the surface affinity of felt and paper and the permeability of the felt for the effect of vacuum on the web. The process of the type mentioned at the outset should, moreover, be further developed in such a way that an improvement in the moisture cross direction profile is attained and the danger of so-called edge pulling is reduced.

In order to attain this goal, a process is recommended according to the invention for conditioning a circulating felt belt of a machine, in particular a paper machine, used to produce a fibrous material web, in particular a paper or cardboard web, in which a zonal conditioning is performed across the width of the felt belt in that the amounts of the conditioning medium added at the various zones are separately adjusted in accordance with the respective, in particular variable, target values.

Thus, the problems mentioned above are eliminated. For example, the effectiveness of the above-mentioned conditioning devices across the width of the felt can optionally also be different, whereby the cross profiles can be correspondingly improved and the danger of a so-called edge pulling can be correspondingly reduced. Good web running properties are guaranteed. Certain properties across the width of the felt, especially in particular in the edge areas, can be correspondingly taken into account and differences between the upper felt and the lower felt can be eliminated. In other words, the profile correction can move only in a working window that is determined by the web running requirements. Web running properties are, in particular, the surface affinity of felt and paper and the permeability of the felt for the effect of vacuum on the web. An improvement in the moisture cross direction profile is attained and the danger of so-called edge pulling is reduced. In general, a more optimal adaptation is possible.

The dosing of conditioning medium, which may optionally differ, across the width of the felt belt can occur in various ways.

According to an advantageous practical embodiment, the conditioning medium is preferably diluted uniformly outside the machine.

If the introduction of conditioning medium occurs at least partially by means of at least one traversing application unit, then the amount of conditioning medium determined for each zone is preferably set using the lag time of the traversing application unit in the respective zone.

If the introduction of conditioning medium occurs at least partially by means of a plurality of stationary nozzles arranged across the width of the felt, to which nozzles a corresponding number of valves is assigned, then the amount of conditioning medium determined for each zone is preferably set by means of a respective valve assigned to the nozzle in question.

According to a suitable practical embodiment of the process according to the invention, the conditioning medium, which preferably contains conditioning chemicals, is mixed into the conditioning water.

According to another advantageous embodiment, the conditioning medium, preferably conditioning chemicals, can be supplied to at least one application device provided especially for chemical conditioning.

It is also advantageous for a preferably zonal regulation of the amount of conditioning medium supplied to be provided.

Further possibilities for treating and/or conditioning the felt are as follows, for example:

- Pressurized air for blowing out water, e.g., regulation of the water content
- Chemical conditioning additives, profiling by means of amount and/or dosing, e.g., regulation of the permeability
- All methods of treatment and/or conditioning are possible on the paper side and/or the running side.

Felt properties, for example, water content or permeability, change with their running time, sometimes also unevenly across the felt width, whereby the moisture cross direction profile of the paper web can be negatively influenced. Moreover, as a result the runnability of the paper web can also be negatively influenced (web edge problems). Reference is again made by way of example to the above-mentioned web running problems and the like occurring in connection with the felt conditioning.

A further aspect of the invention is therefore to further develop the process of the type mentioned at the outset in such a way that, in order to achieve an optimal dry matter content with a good moisture cross direction profile after the press, even and targeted felt properties are guaranteed across the width of the felt belt and a good web run can be guaranteed by virtue of targeted felt properties.

In order to attain this goal, a process for conditioning a circulating felt belt of a machine, in particular a paper machine, used to produce a fibrous material web, in particular a paper or cardboard web, is recommended according to the invention in which a zonal conditioning is performed across the width of the felt belt in that at least one felt belt property cross profile is measured and zonal conditioning elements across the width of the felt belt are adjusted to correspond to the measured felt belt property cross profile.

Here, in particular, an adjustment of zonal or sectional conditioning elements provided across the width of the felt belt corresponding to the felt belt property cross profiles (for example, pressure HD-SR↑, vacuum RS↓ at dry points on the felt) is possible.

According to an advantageous embodiment of the process according to the invention, the felt belt property cross profile is measured by means of an online measurement device, with a closed-loop control preferably being formed in connection with each of the zonal conditioning elements.

In certain cases, it is advantageous for at least one predeterminable felt property mean value and/or at least one predeterminable ratio of a felt property mean value for an upper felt and a lower felt to be adjusted. Here, the respective felt property mean value and/or the respective ratio of felt property mean values for the upper and lower felt of a double-felted pressing nip can be adjusted for the purpose of achieving an optimal dry matter content and an optimal moisture cross direction profile after the nip and/or after the pressing section with optimal web running.

It is also advantageous for the moisture cross direction profile and/or the dewatering amounts occurring in grooves and/or pipe suction apparatus to be measured online immediately after the pressing section and for the zonal conditioning elements to be adjusted depending upon the measuring results attained thereby.

Thus, for example, the online measurement of the moisture cross direction profile directly after the pressing section, in particular in conjunction with the above-mentioned measures and optionally including the measured dewatering amounts at the grooves and pipe suction apparatuses in question, which preferably occurs online as well, allows a complex regulation cycle for achieving an optimal dry matter content and an optimal moisture cross direction profile after the press and an optimal web running; this complex regulation cycle could also possibly be constructed in a self-learning manner.

The invention further relates to a pipe suction apparatus for conditioning a circulating felt belt that is suitable in a particular way for performing the process according to the invention.

According to a first variant embodiment, the pipe suction apparatus according to the invention is provided with a ceramic body extending at least essentially across the entire width of the felt, which ceramic body is provided with a slotted surface, by way of which the felt belt may be subjected to vacuum, with the respective effective amount of slotted surface being variably adjustable by means of movable tongues, e.g., metal tongues, for the purpose of, in particular, correspondingly varying the respective effective time of the vacuum.

According to another variant embodiment of the invention, a traversing pipe suction apparatus is provided for conditioning a circulating felt belt having a ceramic body that is provided with a slotted surface by way of which the felt belt can be subjected to vacuum, with the effect amount of slotted surface is variably adjustable, in particular by means of at least one movable tongue, e.g., metal tongues, for the purpose of, in particular, correspondingly varying the respective effective time of the vacuum.

According to the invention, the process for conditioning a circulating felt belt of a machine for producing a fibrous material web, comprises performing a zonal conditioning of a plurality of zones across a width of the felt belt by measuring at least one of: fibrous material web cross direction profile; felt belt cross direction profile; and permeability of the felt belt across the width of at least one of the web and the belt, and further comprises conditioning the felt belt depending on measuring results obtained for a respective zone. The machine may comprise a paper making machine. The fibrous material web may comprise one of a paper or cardboard web. The fibrous material web cross direction profile may comprise a moisture cross direction profile of the fibrous material web. The felt belt cross direction profile may comprise a water content of the felt belt across the width of at least one of the web and the belt.

According to another aspect of the invention, the process further comprises calculating a mean value from the measured values obtained for the various zones and selecting the intensity of the conditioning in each zone depending upon the deviation of the measuring results obtained for the respective zone from the mean value.

The felt conditioning may occur at least partially by way of a traversing spraying nozzle. Alternatively, the felt conditioning may occur at least partially by way of at least one spraying pipe that includes several nozzles. The at least one spraying pipe may be zonally controllable. The process may further comprise moving the at least one spraying pipe across the width of the zones. Alternatively, the felt conditioning may occur at least partially by way of at least one pipe suction apparatus. The at least one pipe suction apparatus may be zonally controllable.

The process, according to a further aspect of the invention, comprises moving the at least one pipe suction apparatus across a width of the zones. The pipe suction apparatus includes a ceramic body extending at least essentially across the entire width of the felt belt, and the process further comprises subjecting the felt belt to vacuum by way of a slotted surface formed in the ceramic body, and variably adjusting, by zones, an effective slotted portion of the surface, to vary, a respective effective time of being subjected to vacuum.

The process, according to the invention, further comprises variably adjusting, by way of movable tongues, an effective slotted portion of the surface. The movable tongues may comprise metal tongues.

The felt conditioning may occur at least partially by way of at least one traversing short pipe suction apparatus including a ceramic body provided with a slotted surface by way of which the felt belt is subjectable to vacuum, and further by variably adjusting by zones, an effective slotted portion of the surface to vary a respective effective time of being subjected to vacuum. An effective slotted portion of the surface may be variably adjustable by using movable tongues. The movable tongues may comprise metal tongues.

The zonal conditioning comprises supplying separately adjustable amounts of conditioning medium to various zones in accordance with respective target values, which may be variable. The conditioning medium may be diluted outside of the machine. The supplying of conditioning medium may occur at least partially by way of at least one traversing application unit, and determining the amount of conditioning medium supplied to each zone by using a lag time of the traversing application unit in the respective zone.

According to an alternative aspect of the invention, the supplying of conditioning medium occurs at least partially by way of a plurality of stationary nozzles provided across the width of the felt belt, with a corresponding number of valves being assigned to the nozzles, and the amount of conditioning medium supplied being determined for each zone by way of a respective valve assigned to the relevant nozzle. The zonal conditioning may comprise supplying conditioning medium across a width of the felt belt. The conditioning medium may comprise conditioning chemicals mixed into conditioning water. Further, the conditioning medium may comprise conditioning chemicals supplied to at least one conditioning device provided only for chemical conditioning.

The invention further comprises providing a zonal regulation of the supplied conditioning medium and measuring at least one felt belt cross direction profile and adjusting zonal conditioning elements across the width of the felt belt according to the measured felt belt cross direction profile.

The felt belt cross direction profile is measured by way of an online measuring device, with a closed-loop control preferably being formed in connection with each of the zonal conditioning elements. The invention further comprises setting at least one of predeterminable felt mean value and predeterminable ratio of a felt mean value for at least one of an upper felt and a lower felt.

Another aspect of the invention includes setting the at least one of predeterminable felt mean value and predeterminable ratio of a felt mean value, depending on at least one of a desired dry matter content and moisture cross direction profile after a respective at least one of a pressing nip and a press section. A further aspect of the invention includes measuring online, immediately after the press section, at least one of a moisture cross direction profile and dewatering amounts occurring at at least one of grooves and pipe suction apparatus and adjusting the zonal conditioning elements depending on the measuring result that is obtained therefrom.

Moreover, according to the invention, there is provided a pipe suction apparatus for conditioning a circulating felt belt, wherein a zonal conditioning of a plurality of zones across a width of the felt belt is performed by measuring at least one of fibrous material web cross direction profile; felt belt cross direction profile; and permeability of the felt belt across the width of at least one of the web and the belt; and further comprising conditioning the felt belt depending on measuring results obtained for a respective zone, wherein the apparatus comprises a ceramic body extending at least essentially across the entire width of the felt belt, the ceramic body being provided with a slotted surface by way of which the felt belt is subjectable to vacuum, with a respective effective amount of slotted surface being zonally variably adjustable by way of movable tongues.

The movable tongues may comprise metal tongues. A respective effective time of being subjected to vacuum is correspondingly varied.

According to yet another aspect of the invention, a traversing pipe suction apparatus for conditioning a circulating felt belt, includes a zonal conditioning of a plurality of zones across a width of the felt belt performed by measuring at least one of fibrous material web cross direction profile; felt belt cross direction profile; and permeability of the felt belt across the width of at least one of the web and the belt, and further includes conditioning the felt belt depending on measuring results obtained for a respective zone, wherein the apparatus comprises a ceramic body provided with a slotted surface by way of which the felt belt is subjectable to vacuum, with an effective amount of slotted surface being variably adjustable by way of at least one movable tongue. The movable tongue may comprises a metal tongue. A respective effective time of being subjected to vacuum is correspondingly varied.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
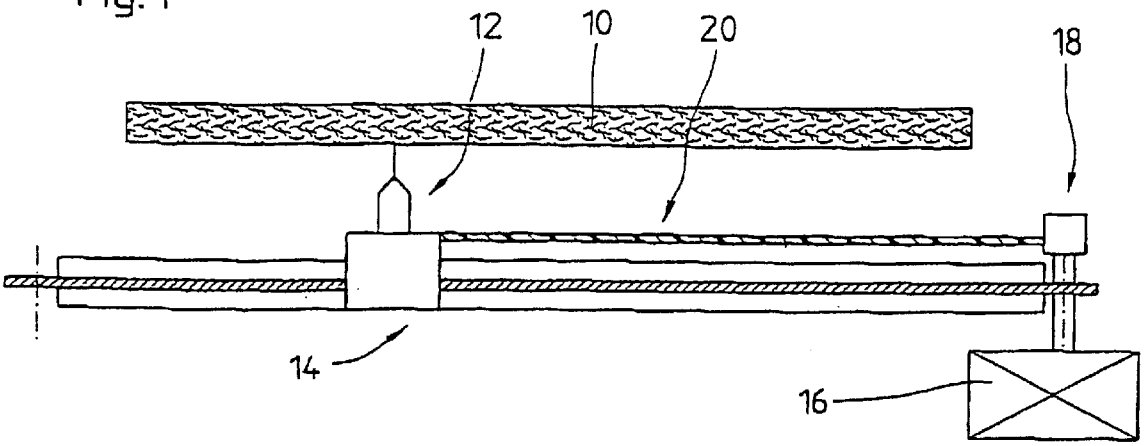
FIG. 1 shows a schematic depiction of a traversing spraying pipe nozzle.
Figure 2:
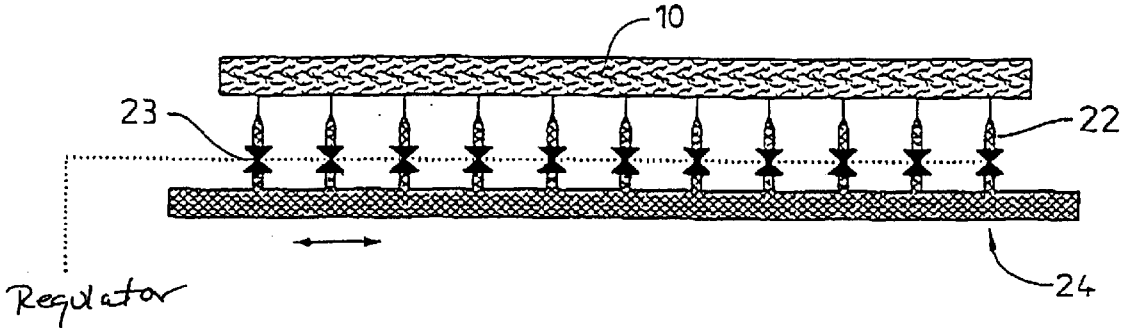
FIG. 2 shows a schematic depiction of a zonally controllable spraying pipe containing several nozzles
Figure 3:
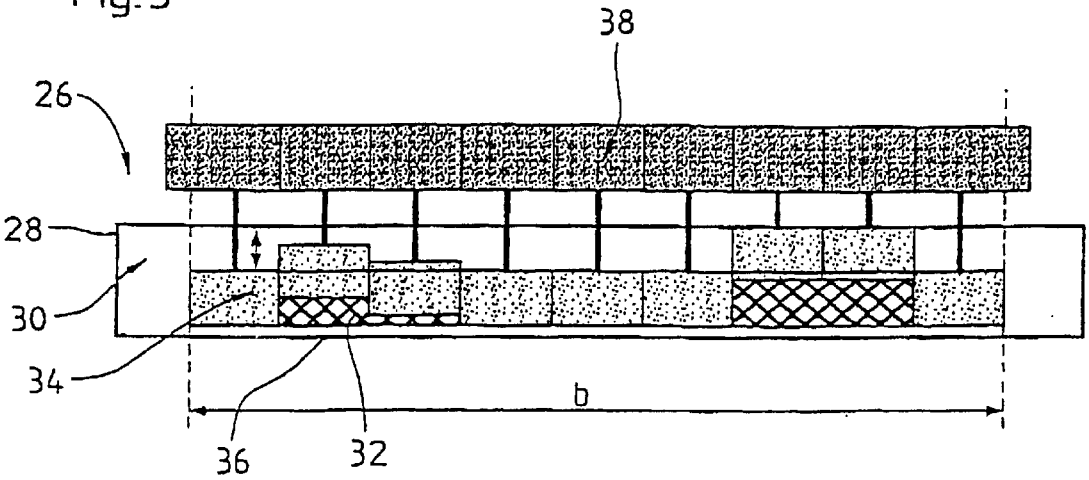
FIG. 3 shows a schematic depiction of a pipe suction apparatus acting zonally.

FIGS. 1 to 3 show purely by way of example various devices for the zonal or sectional conditioning of a respective felt belt 10 across the width of the felt belt.

Here, deviations in the moisture cross direction profile are to be corrected and an even moisture cross direction profile is to be attained by means of a targeted conditioning of the felt belt 10 in places in which a particularly high degree of compression or contamination is present. For this purpose, water is added in a targeted manner to compressed points on the felt belt 10, for example, by means of a traversing spraying pipe nozzle, for example, a high-pressure spraying pipe nozzle (cf. FIG. 1), or a spraying pipe, for example, a high-pressure spraying pipe (cf. FIG. 2) and/or water is suctioned off in a targeted manner from compressed points on the felt belt 10, for example, by means of a pipe suction apparatus (cf. FIG. 3).

First, the moisture cross direction profile of the fibrous material web, in particular the paper or cardboard web, or the water content of the felt belt 10 across the width of the web and/or the belt or the permeability of the felt belt 10 across the width of the felt belt must be detected using measurement technology. At the points at which a higher moisture content of the fibrous material web, a lower water content of the felt, or a lower permeability of the felt is measured, the targeted zonal conditioning of the felt belt 10 occurs in addition to the conventional felt conditioning that is effective across the entire width of the fibrous material web and/or the felt belt. The intensity of the zonal conditioning is regulated according to the amount of deviation of the above-mentioned measurement values from a mean value obtained across the width of the web and/or the belt.

FIG. 1 shows in schematic depiction a traversing spraying pipe nozzle 12, e.g., a high-pressure spraying pipe nozzle, that is suitable therefor, which can approach all points across the width of the felt belt 10 by means of a guide, for example, a guide rail 14. Here, the spraying pipe nozzle 12 can either move at an even speed across the felt belt 10, with the water pressure being regulated with the cross profile deviation as a correcting variable, or the speed of this traversing spraying pipe nozzle 12 and thus its lag time at certain positions being regulated with the cross profile deviation as a correcting variable, with the water pressure remaining constant.

Moreover, a drive 16, formed here by an electromotor, a wound hose 18, and a hose 20 leading to the traversing spraying pipe nozzle 12 can be seen in FIG. 1.

The spraying pipe 24, e.g., a high-pressure spraying pipe, shown schematically in FIG. 2, which has several nozzles, such as, for example, high-pressure nozzles, and may be controlled and/or regulated in zones, is also suitable for performing the process. The individual spraying pipe nozzles 22 can be controlled by means of the respective valves 23 in order to render possible a targeted conditioning of the individual felt regions. Here, it is possible, in particular, for a regulation of the individual valves 23 to be performed in accordance with the applicable cross profile measurement.

The zonally active pipe suction apparatus 26 shown schematically in FIG. 3, with which individual felt regions can be suctioned, is also suitable for performing the process. According to the exemplary embodiment shown in this FIG. 3, the pipe suction apparatus 26 can include a ceramic body 28 extending across the entire width of the felt, in which a certain portion of its surface 30 has slots 32 by way of which the vacuum can act on the felt belt 10 (cf. FIGS. 1 and 2) and in which, in particular by means of movable tongues 34, e.g., metal tongues, the slotted surface 36 and thus the effective time of the vacuum can be varied. A pneumatic regulation of the open surface is possible by way of a corresponding device 38. As was already mentioned at the outset, however, a traversing short pipe suction apparatus can be provided as well, for example.

Figure 4:
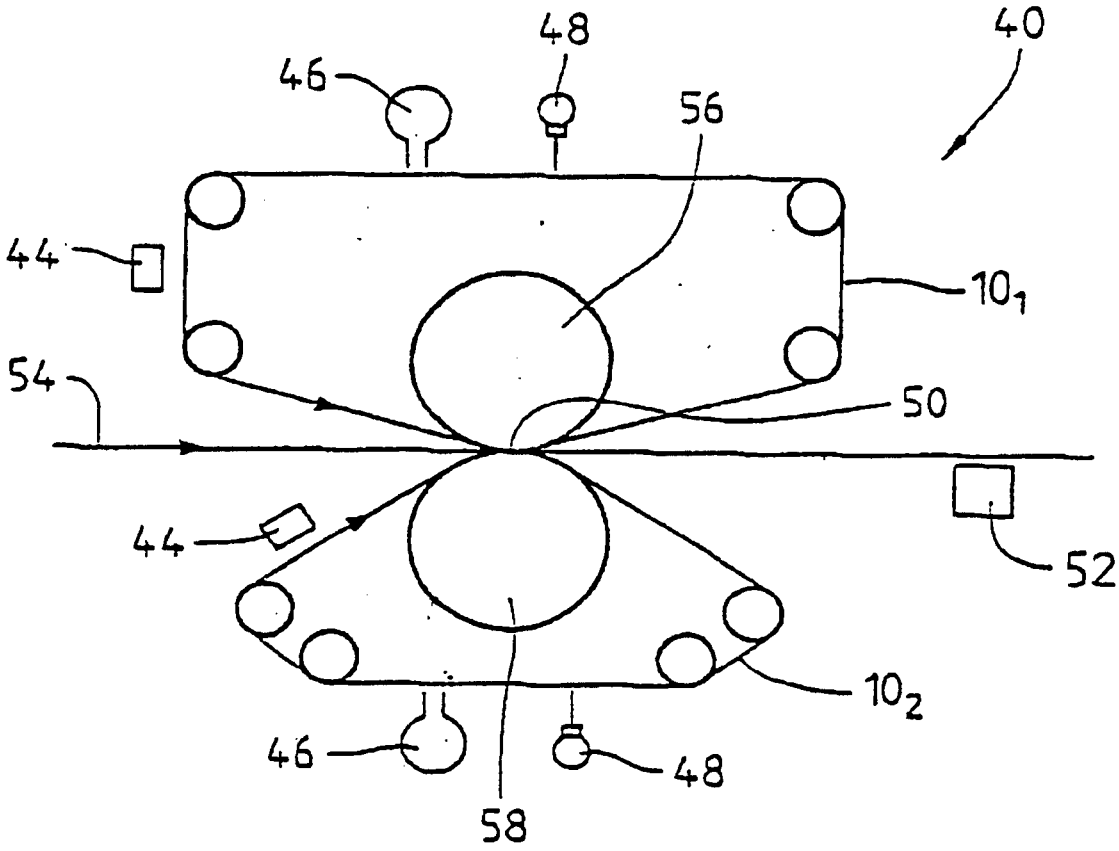
FIG. 4 shows a schematic depiction of a double-felted press whose two felts can be conditioned zonally.

FIG. 4 shows in schematic depiction a double-felted press 40 whose two felt belts $\mathbf{10}_1$, $\mathbf{10}_2$ can each be zonally conditioned.

Here, felt belt property cross profiles are measured by way of corresponding measuring devices 44. Zonal or sectional conditioning elements 46, 48 provided across the width of the respective felt belts $\mathbf{10}_1$, $\mathbf{10}_2$ are adjusted in accordance with the felt belt property cross profiles (for example, pressure HD-SR↑, vacuum RS↓ at dry points on the respective felt belt).

Optionally, an online measuring device for measuring a respective felt belt property cross profile can be provided. A closed-loop control is possible with this device in connection with the sectional or zonal conditioning elements 46, 48. Felt property mean values and/or ratios of felt property mean values for the upper felt $\mathbf{10}_1$, and the lower felt $\mathbf{10}_2$ of the double-felted pressing nip 50 can be adjusted for the purpose of achieving an optimal dry matter content and moisture cross direction profile after the pressing nip 50 and/or after the pressing section with an optimal web running.

By means of a measuring device 52, it is possible to measure the moisture cross direction profile of the fibrous material web 54 online immediately after the pressing section, which, in conjunction with the above-mentioned measures and optionally including the measured dewatering amounts at the grooves and pipe suction apparatus, which preferably occurs online as well, renders possible a complex control loop for achieving an optimal dry matter content and an optimal moisture cross direction profile after the press 40; this complex control loop could also possibly be constructed in a self-learning manner.

The fibrous material web 54 can, in particular, be a paper or cardboard web. Traversing spraying pipe nozzles, zonally controllable spraying pipes, and/or zonally acting pipe suction apparatus, for example, can be used again as the conditioning elements 46, 48. They can, for example, again have a construction such as described above. As can be seen from FIG. 4, the double-felted pressing nip 50 is formed between two pressing rolls 56, 58 in the present case.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| List of Reference Characters | |
|---|---|
| 10 | Felt belt |
| $10_1$ | Upper felt belt |
| $10_2$ | Lower felt belt |
| 12 | Traversing spraying pipe nozzle |
| 14 | Guide rails |
| 16 | Drive |
| 18 | Wound hose |
| 20 | Hose |
| 22 | Nozzles |
| 23 | Valves |
| 24 | Spraying pipe |
| 26 | Pipe suction apparatus |
| 28 | Ceramic body |
| 30 | Ceramic surface |
| 32 | Slots |
| 34 | Tongues |
| 36 | Slotted surface |
| 38 | Device |
| 40 | Press |
| 42 | Measuring device |
| 44 | Measuring device |
| 46 | Conditioning element |
| 48 | Conditioning element |
| 50 | Pressing nip |
| 52 | Measuring device |
| 54 | Fibrous material web |
| 56 | Pressing roll |
| 58 | Pressing roll |
| b | Felt width |

What is claimed:

1. Process for conditioning a circulating felt belt of a machine for producing a fibrous material web, comprising:

performing a zonal conditioning of a plurality of zones across a width of the felt belt by measuring at least one of:

fibrous material web cross direction profile;

felt belt cross direction profile; and permeability of the felt belt across the width of at least one of the web and the belt;

conditioning said felt belt depending on measuring results obtained for a respective zone;

diluting, outside of the machine, the condition medium, wherein said zonal conditioning comprises supplying seperately adjustable amounts of conditioning medium to various zones in accordance with respective target values, and wherein said values are variable.

2. Process for conditioning a circulating felt belt of a machine for producing a fibrous material web, comprising:

performing a zonal conditioning of a plurality of zones across a width of the felt belt by measuring at least one of:

fibrous material web cross direction profile;

felt belt cross direction profile; and permeability of the felt belt across the width of at least one of the web and the belt;

conditioning said felt belt depending on measuring results obtained for a respective zone;

wherein said zonal conditioning comprises supplying seperately adjustable amounts of conditioning medium to various zones in accordance with respective target values, wherein said target values are variable, and wherein the supplying of conditioning medium occurs at least partially by ways of at least one traversing application unit, and determining the amount of conditioning medium supplied to each zone by using a lag time of the traversing application unit in the respective zone.

3. A process for conditioning a circulating felt belt of a machine for producing a fibrous material web, the process comprising:

measuring, to determine measuring results, at least one of:

fibrous material web cross direction profile;

felt belt cross direction profile; and permeability of the felt belt across the width of at least one of the fibrous material web and the circulating felt belt;

calculating a mean value from the measuring results; and conditioning each of a plurality of zones of the circulating felt belt depending on the measuring results, wherein an intensity of the conditioning in each zone of the circulating felt belt depends upon a deviation between the measuring results obtained for a respective zone and the mean value, and wherein the conditioning is utilized to acheive an optimum dry matter content and good moisture cross direction profile of the fibrous material web.

4. The process according to claim 3, wherein said machine comprises a paper making machine.

5. The process according to claim 4, wherein said fibrous material web comprises one of a paper or cardboard web.

6. The process according to claim 5, wherein the fibrous material web cross direction profile comprises a moisture cross direction profile of the fibrous material web.

7. The process according to claim 6, wherein the felt belt cross direction profile comprises a water content of the circulating felt belt.

8. The process according to claim 3, wherein the conditioning occurs at least partially by way of a traversing spraying nozzle.

9. The process according to claim 3, wherein the conditioning occurs at least partially by way of at least one spraying pipe that includes several nozzles.

10. The process according to claim 9, wherein the at least one spraying pipe is zonally controllable.

11. The process according to claim 10, further comprising moving said at least one spraying pipe across the width of the circulating felt belt.

12. The process according to claim 3, wherein the felt conditioning occurs at least partially by way of at least one pipe suction apparatus.

13. The process according to claim 12, wherein said at least one pipe suction apparatus is zonally controllable.

14. The process according to claim 13, further comprising moving the at least one pipe suction apparatus across a width of the circulating felt belt.

15. The process according to claim 14, wherein the at least one pipe suction apparatus includes a ceramic body extending at least essentially across an entire width of the circulating felt belt, and wherein the process further comprises:

subjecting the circulating felt belt to vacuum by way of a slotted surface formed in the ceramic body, and variably adjusting, by zones, an effective slotted portion of the slotted surface, to vary, a respective effective time of being subjected to vacuum.

16. The process according to claim 15, further comprising variably adjusting, by way of movable tongues, an effective slotted portion of the slotted surface.

17. The process according to claim 16, wherein the movable tongues comprise metal tongues.

18. The process according to claim 3, wherein the conditioning occurs at least partially by way of at least one traversing short pipe suction apparatus including a ceramic body provided with a slotted surface by way of which the circulating felt belt is subjectable to vacuum, and wherein the process further comprises:

variably adjusting by zones, an effective slotted portion of the slotted surface to vary a respective effective time of being subjected to vacuum.

19. The process according to claim 18, wherein the effective slotted portion of the slotted surface is variably adjustable by using movable tongues.

20. The process according to claim 19, wherein the movable tongues comprise metal tongues.

21. The process according to claim 3, wherein the conditioning comprises supplying separately adjustable amounts of conditioning medium to various zones in accordance with respective target values.

22. The process according to claim 21, wherein the respective target values are variable.

23. The process according to claim 22, further comprising diluting, outside of the machine, the conditioning medium.

24. The process according to claim 21, wherein the supplying occurs at least partially by way of at least one traversing application unit, and wherein the process further comprises:

determining the amount of conditioning medium supplied to each zone by using a lag time of a traversing application unit in the respective zone.

25. The process according to claim 21, wherein the supplying occurs at least partially by way of a plurality of stationary nozzles provided across the width of the felt belt, with a corresponding number of valves being assigned to the stationary nozzles, and wherein the amount of conditioning medium supplied is determined for each zone by way of a respective valve assigned to a respective stationary nozzle.

26. The process according to claim 3, wherein the conditioning comprises supplying conditioning medium across a width of the circulating felt belt.

27. The process according to claim 26, wherein the conditioning medium comprises conditioning chemicals that are mixed into conditioning water.

28. The process according to claim 26, wherein the conditioning medium comprises conditioning chemicals supplied to at least one conditioning device provided only for chemical conditioning.

29. The process according to claim 26, further comprising providing a zonal regulation of the supplied conditioning medium.

30. The process according to claim 3, wherein the measuring comprises measuring at least the felt belt cross direction profile and wherein the conditioning comprises adjusting zonal conditioning elements across the width of the circulating felt belt.

31. The process according to claim 30, wherein the felt belt cross direction profile is measured by way of an online measuring device, with a closed-loop control preferably being formed in connection with each of the zonal conditioning elements.

32. The process according to claim 30, further comprising setting at least one of:

predeterminable felt mean value; and predeterminable ratio of a felt mean value for at least one of an upper felt and a lower felt.

33. Thee process according to claim 30, further comprising setting at least one of a predeterminable felt mean value and a predeterminable ratio of a felt mean value, depending on at least one of a desired dry matter content and moisture cross direction profile after at least one of a pressing nip.

34. The process according to claim 33, further comprising:

measuring online, immediately after a press section, at least one of a moisture cross direction profile and dewatering amounts occurring at at least one of grooves and a pipe suction apparatus; and adjusting the zonal conditioning elements depending on a measured result obtained in the measuring online.

35. A process for conditioning a circulating felt belt of a machine for producing a fibrous material web, the process comprising:

measuring a cross direction profile of the fibrous material web;

determining measurement results for a plurality of zones of the fibrous material web;

measuring at least one of:

a cross direction profile of the circulating felt belt; and a permeability of the circulating felt belt transverse to a running direction;

determining measurements results for a plurality of zones of the circulating felt belt; and conditioning the plurality of zones of the circulating felt belt depending on the measurement results obtained for respective zones of the fibrous material web and the circulating felt belt.

36. The process according to claim 35, wherein the machine comprises a paper making machine.

37. The process according to claim 36, wherein the fibrous material web comprises one of a paper or cardboard web.

38. The process according to claim 36, wherein the cross direction profile of the fibrous material web comprises a moisture cross direction profile of the fibrous material web.

39. The process according to claim 38, wherein the cross direction profile of the circulating felt belt comprises a water content of the circulating felt belt.

40. The process according to claim 38, wherein the measurement results of the cross direction profile of the circulating felt belt relates to water content.

41. The process according to claim 35, wherein the conditioning occurs at least partially by way of a traversing spraying nozzle.

42. The process according to claim 35, wherein the conditioning occurs at least partially by way of at least one spraying pipe that includes several nozzles.

43. The process according to claim 42, wherein the at least one spraying pipe is zonally controlled.

44. The process according to claim 42, further comprising moving said at least one spraying pipe across the width of the circulating felt belt.

45. The process according to claim 35, wherein the conditioning occurs at least partially by way of at least one pipe suction apparatus.

46. The process according to claim 45, wherein the at least one pipe suction apparatus is zonally controlled.

47. The process according to claim 45, further comprising moving the at least one pipe suction apparatus across a width of the circulating felt belt.

48. The process according to claim 46, wherein the at least one pipe suction apparatus includes a ceramic body extending at least essentially across an entire width of the circulating felt belt, and wherein the process further comprises:

subjecting the circulating felt belt to vacuum by way of a slotted surface formed in the ceramic body, and variably adjusting, by zone, an effective slotted portion of the slotted surface, to vary the vacuum in a respective zone.

49. The process according to claim 48, further comprising variably adjusting, by way of movable tongues, the effective slotted portion of the slotted surface.

50. The process according to claim 49, wherein the movable tongues comprise metal tongues.

51. The process according to claim 35, wherein the conditioning occurs at least partially by way of at least one traversing short pipe suction apparatus that includes a ceramic body having a slotted surface that subjects the circulating felt belt to vacuum, and wherein the process further comprises:

variably adjusting, by zone, an effective slotted portion of the slotted surface.

52. The process according to claim 51, wherein the effective slotted portion of the slotted surface is variably adjustable via movable tongues.

53. The process according to claim 52, wherein the movable tongues comprise metal tongues.

54. The process according to claim 35, wherein the conditioning comprises supplying separately adjustable amounts of conditioning medium to various zones in accordance with respective target values.

55. The process according to claim 54, wherein the respective target values are variable.

56. The process according to claim 35, wherein the conditioning comprises applying a diluted conditioning medium.

57. The process according to claim 54, wherein the supplying occurs at least partially by way of at least one traversing application unit, and wherein the process further comprises:

determining amounts of the conditioning medium supplied to each zone by using a lag time of a traversing application unit in a respective zone.

58. The process according to claim 54, wherein the supplying occurs at least partially by way of a plurality of stationary nozzles provided across the width of the circulating felt belt, with a corresponding number of values being assigned to the stationary nozzles, and wherein the amount of conditioning medium supplied is determined for each zone by way of a respective valve assigned to a respective stationary nozzle.

59. The process according to claim 35, wherein the conditioning comprises supplying conditioning medium across a width of the circulating felt belt.

60. The process according to claim 59, wherein the conditioning medium comprises conditioning chemicals that are mixed into conditioning water.

61. The process according to claim 59, wherein the conditioning medium comprises conditioning chemicals supplied to at least one conditioning device provided only for chemical conditioning.

62. The process according to claim 59, further comprising providing a zonal regulation of the supplied conditioning medium.

63. The process according to claim 35, wherein the measuring comprises measuring at least the cross direction profile of the circulating felt belt and wherein the conditioning comprises adjusting zonal conditioning elements across the width of the circulating felt belt.

64. The process according to claim 63, wherein the cross direction profile of the circulating felt belt is measured by way of an online measuring device utilizing closed-loop control.

65. The process according to claim 63, further comprising setting at least one of:

predetermined felt mean value; and predetermined ratio of a felt mean value for at least one of an upper felt and a lower felt.

66. The process according to claim 63, further comprising setting at least one of a predeterminable felt mean value and a predeterminable ratio of a felt mean value, depending on at least one of a desired dry matter content and moisture cross direction profile after at least one of a pressing nip.

67. The process according to claim 35, wherein the measuring occurs online and immediately after a press section and wherein the process further comprises:

adjusting conditioning elements depending on the online measuring.

68. The process for conditioning a circulating felt belt of a machine for producing a fibrous material web, comprising:

measuring, in a plurality of zones, across direction profile of the fibrous material web and a cross direction profile of the circulating felt belt;

determining deviations between values measured in the plurality of zones and a mean value; and conditioning each of the plurality of zones of the circulating felt belt depending on the deviations.

69. A pipe suction apparatus for conditioning a circulating felt belt according to the process of claim 68, the apparatus comprising:

a ceramic body extending at least essentially across the entire width of the circulating felt belt;

said ceramic body being provided with a slotted surface by way of which the circulating felt belt is subjectable to vacuum, with a respective effective amount of slotted surface being zonally variably adjustable by way of movable tongues.

70. The pipe suction apparatus according to claim 69, wherein said movable tongues comprise metal tongues.

71. The pipe suction apparatus according to claim 69, wherein the respective effective time is varied.

72. A traversing pipe suction apparatus for conditioning a circulating felt belt according to the process of claim 68, the apparatus comprising:

a ceramic body provided with a slotted surface by way of which the circulating felt belt is subjectable to vacuum, with an effective amount of slotted surface being variably adjustable by way of at least one movable tongue.

73. The traversing pipe suction apparatus according to claim 72, wherein the at least one movable tongue comprises a metal tongue.

74. The traversing pipe suction apparatus according to claim 72, wherein a respective effective time of being subjected to vacuum is correspondingly varied.

75. A process for conditioning a circulating felt belt of a machine for producing a fibrous material web, the process comprising:

measuring a cross direction profile of the fibrous material web and at least one of;

a cross direction profile of the circulating felt belt; and a permeability of the circulating felt belt across a width of the circulating felt belt;

determining a mean value from measured values taken across a width of the fibrous material web;

determining deviations between the measured values and the mean value; and conditioning each of the plurality of zones of the circulating felt belt depending on the deviations.

76. A process of conditioning a circulating felt belt of a machine for producing a fibrous material web, the process comprising:

measuring a cross direction profile of the fibrous material web and at least one of;

a cross direction profile of the circulating felt belt; and a permeability of the circulating felt belt across a width of the circulating felt belt;

determining a mean value from measured values taken across a width of the circulating felt belt;

determining deviations between the measured values and the mean value; and conditioning each of the plurality of zones of the circulating felt belt depending on the deviations.

* * * * *